US008882448B2

(12) United States Patent
Lee

(10) Patent No.: US 8,882,448 B2
(45) **Date of Patent: *Nov. 11, 2014**

(54) COOLING SYSTEM IN A TURBINE AIRFOIL ASSEMBLY INCLUDING ZIGZAG COOLING PASSAGES INTERCONNECTED WITH RADIAL PASSAGEWAYS

(71) Applicant: Ching-Pang Lee, Cincinnati, OH (US)

(72) Inventor: Ching-Pang Lee, Cincinnati, OH (US)

(73) Assignee: Siemens Aktiengesellshaft, München (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/048,074

(22) Filed: Oct. 8, 2013

(65) Prior Publication Data

US 2014/0037461 A1 Feb. 6, 2014

Related U.S. Application Data

(63) Continuation-in-part of application No. 13/228,567, filed on Sep. 9, 2011.

(51) Int. Cl.
*F01D 5/18* (2006.01)

(52) U.S. Cl.
CPC ..... *F01D 5/18* (2013.01); *F05D 2240/122* (2013.01); *F01D 5/186* (2013.01); *F05D 2240/304* (2013.01); *F05D 2260/202* (2013.01); *F05D 2250/183* (2013.01)
USPC ..... 415/115; 416/97 R

(58) Field of Classification Search
USPC ..... 415/115, 116; 416/96 R, 97 R
See application file for complete search history.

(56) References Cited

U.S. PATENT DOCUMENTS

| | | | | |
|---|---|---|---|---|
| 4,203,706 | A * | 5/1980 | Hess | 416/97 A |
| 4,474,532 | A | 10/1984 | Pazder | |
| 5,246,341 | A | 9/1993 | Hall et al. | |
| 5,370,499 | A | 12/1994 | Lee | |
| 5,464,322 | A | 11/1995 | Cunha et al. | |
| 5,752,801 | A * | 5/1998 | Kennedy | 415/115 |
| 5,842,829 | A | 12/1998 | Cunha et al. | |
| 5,975,851 | A | 11/1999 | Liang | |
| 6,056,505 | A | 5/2000 | Cunha et al. | |
| 6,099,252 | A | 8/2000 | Manning et al. | |
| 6,183,194 | B1 | 2/2001 | Cunha et al. | |
| 6,254,334 | B1 | 7/2001 | LaFleur | |
| 6,325,593 | B1 | 12/2001 | Darkins, Jr. et al. | |
| 6,402,470 | B1 | 6/2002 | Kvasnak et al. | |
| 6,499,949 | B2 | 12/2002 | Schafrik et al. | |
| 6,607,356 | B2 | 8/2003 | Manning et al. | |
| 6,616,406 | B2 | 9/2003 | Liang | |
| 6,902,372 | B2 | 6/2005 | Liang | |
| 6,932,573 | B2 | 8/2005 | Liang | |
| 6,984,102 | B2 | 1/2006 | Bunker et al. | |

(Continued)

*Primary Examiner* — Liam McDowell

(57) ABSTRACT

An airfoil in a gas turbine engine includes an outer wall, a cooling fluid cavity, a plurality of cooling fluid passages, and a plurality of radial passageways. The outer wall has leading and trailing edges, pressure and suction sides, and radially inner and outer ends. The cooling fluid cavity is defined in the outer wall and receives cooling fluid for cooling the outer wall. The cooling fluid passages are in fluid communication with the cooling fluid cavity and include alternating angled sections, each section having both a radial component and a chordal component. The cooling fluid passages extend from the cooling fluid cavity toward the trailing edge of the outer wall and receive cooling fluid from the cooling fluid cavity for cooling the outer wall near the trailing edge. The radial passageways interconnect radially adjacent cooling fluid passages.

20 Claims, 5 Drawing Sheets

(56) References Cited

U.S. PATENT DOCUMENTS

| | | | |
|---|---|---|---|
| 7,066,716 | B2 | 6/2006 | Jacala et al. |
| 7,182,576 | B2 | 2/2007 | Bunker et al. |
| 7,186,084 | B2 | 3/2007 | Bunker et al. |
| 7,270,515 | B2 | 9/2007 | Liang |
| 7,293,961 | B2 | 11/2007 | Lee et al. |
| 7,435,053 | B2 | 10/2008 | Liang |
| 7,438,527 | B2 | 10/2008 | Albert et al. |
| 7,452,186 | B2 | 11/2008 | Charbonneau et al. |
| 7,549,844 | B2 | 6/2009 | Liang |
| 7,670,113 | B1 | 3/2010 | Liang |
| 7,780,415 | B2 | 8/2010 | Liang |
| 7,785,070 | B2 | 8/2010 | Liang |
| 7,785,071 | B1 | 8/2010 | Liang |
| 7,806,659 | B1 | 10/2010 | Liang |
| 2005/0226726 | A1 | 10/2005 | Lee et al. |
| 2008/0286115 | A1 | 11/2008 | Liang |
| 2010/0034638 | A1* | 2/2010 | Chambers et al. ..... 415/115 |
| 2011/0171023 | A1* | 7/2011 | Lee et al. ..... 416/1 |

* cited by examiner

COOLING SYSTEM IN A TURBINE AIRFOIL ASSEMBLY INCLUDING ZIGZAG COOLING PASSAGES INTERCONNECTED WITH RADIAL PASSAGEWAYS

CROSS REFERENCE TO RELATED APPLICATIONS

This application is a Continuation-In-Part of U.S. patent application Ser. No. 13/228,567, filed Sep. 9, 2011, entitled "TRAILING EDGE COOLING SYSTEM IN A TURBINE AIRFOIL ASSEMBLY" by Ching-Pang Lee, the entire disclosure of which is incorporated by reference herein.

FIELD OF THE INVENTION

The present invention relates to a cooling system in a turbine engine, and more particularly, to a system for cooling a trailing edge portion of an airfoil assembly.

BACKGROUND OF THE INVENTION

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoil assemblies, e.g., stationary vanes and rotating blades within the turbine section, must be cooled with cooling fluid, such as air discharged from a compressor in the compressor section, to prevent overheating of the components.

SUMMARY OF THE INVENTION

In accordance with a first aspect of the present invention, an airfoil is provided in a gas turbine engine. The airfoil comprises an outer wall, a cooling fluid cavity, a plurality of cooling fluid passages, and a plurality of radial passageways. The outer wall includes a leading edge, a trailing edge, a pressure side, a suction side, a radially inner end, and a radially outer end, wherein a chordal direction is defined between the leading and trailing edges. The cooling fluid cavity is defined in the outer wall, extends generally radially between the inner and outer ends of the outer wall, and receives cooling fluid for cooling the outer wall. The cooling fluid passages are in fluid communication with the cooling fluid cavity and comprise alternating angled sections, each section having both a radial component and a chordal component. The cooling fluid passages extend from the cooling fluid cavity toward the trailing edge of the outer wall and receive cooling fluid from the cooling fluid cavity for cooling the outer wall near the trailing edge. The radial passageways interconnect radially adjacent cooling fluid passages.

In accordance with a second aspect of the present invention, an airfoil is provided in a gas turbine engine. The airfoil comprises an outer wall, a cooling fluid cavity, a plurality of cooling fluid passages, and a plurality of radial passageways. The outer wall includes a leading edge, a trailing edge, a pressure side, a suction side, a radially inner end, and a radially outer end, wherein a chordal direction is defined between the leading and trailing edges. The cooling fluid cavity is defined in the outer wall and receives cooling fluid for cooling the outer wall. The cooling fluid passages include alternating angled sections, each section extending radially and chordally toward the trailing edge of the outer wall. The cooling fluid passages receive cooling fluid from the cooling fluid cavity for cooling the outer wall near the trailing edge. The radial passageways interconnect radially adjacent cooling fluid passages and are formed between radial peaks and radial valleys of respective radially adjacent cooling fluid passages.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
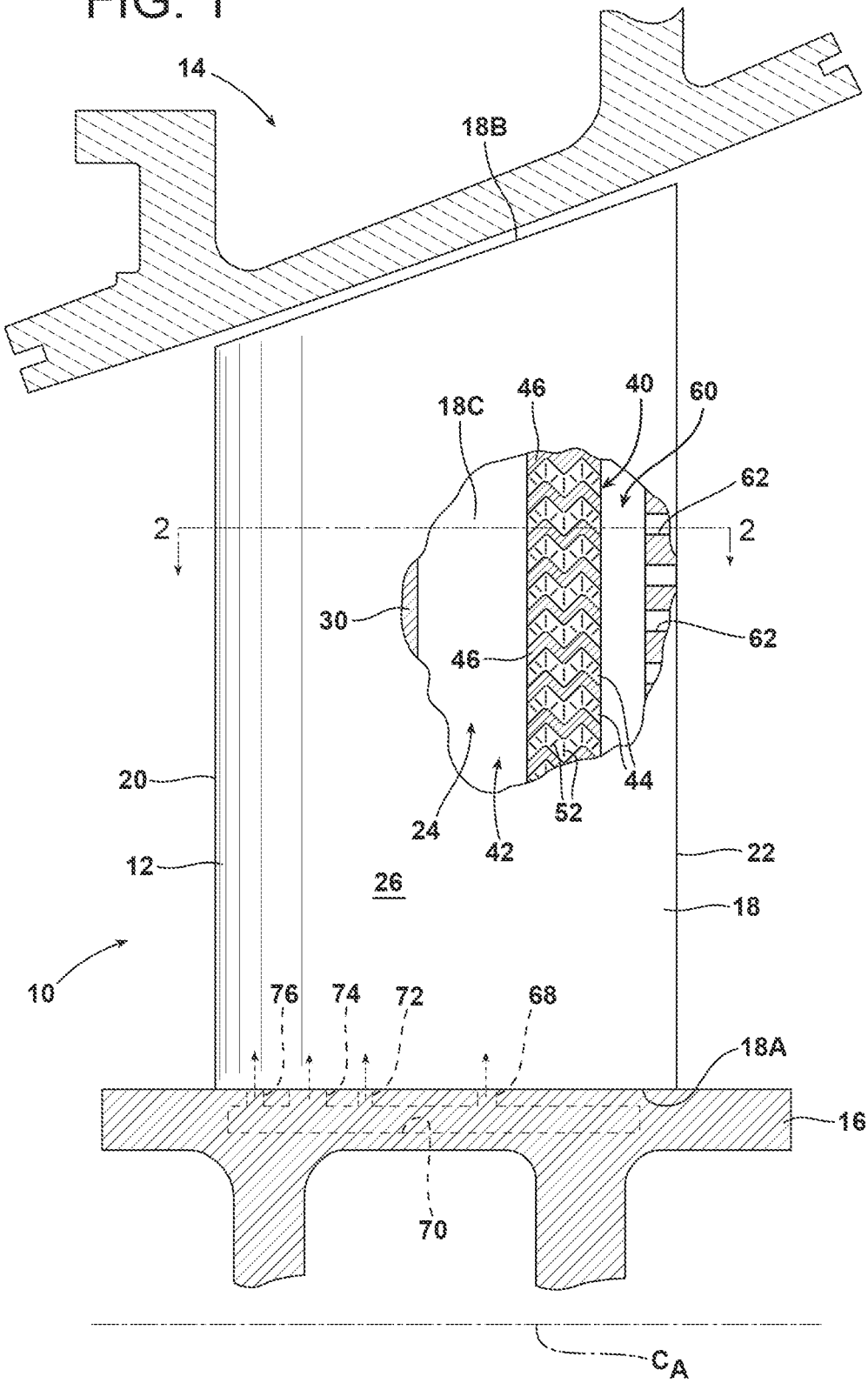
FIG. 1 is a side cross sectional view of an airfoil assembly to be cooled in a gas turbine engine according to an embodiment of the invention, wherein a portion of a suction side of the airfoil assembly has been removed.

Referring now to FIG. 1, an airfoil assembly 10 constructed in accordance with a first embodiment of the present invention is illustrated. In the embodiment illustrated in FIG. 1, the airfoil assembly 10 is a blade assembly comprising an airfoil, i.e., a rotatable blade 12, although it is understood that the cooling concepts disclosed herein could be used in combination with a stationary vane. The airfoil assembly 10 is for use in a turbine section 14 of a gas turbine engine.

As will be apparent to those skilled in the art, the gas turbine engine includes a compressor section (not shown), a combustor section (not shown), and the turbine section 14. The compressor section includes a compressor that compresses ambient air, at least a portion of which is conveyed to the combustor section. The combustor section includes one or more combustors that combine the compressed air from the compressor section with a fuel and ignite the mixture creating combustion products defining a high temperature working gas. The high temperature working gas travels to the turbine section 14 where the working gas passes through one or more turbine stages, each turbine stage comprising a row of stationary vanes and a row of rotating blades. It is contemplated that the airfoil assembly 10 illustrated in FIG. 1 may be included in a first row of rotating blade assemblies in the turbine section 14.

The vane and blade assemblies in the turbine section 14 are exposed to the high temperature working gas as the working gas passes through the turbine section 14. Cooling air from the compressor section may be provided to cool the vane and blade assemblies, as will be described herein.

As shown in FIG. 1, the airfoil assembly 10 comprises the blade 12 and a platform assembly 16 that is coupled to a turbine rotor (not shown) and to which the blade 12 is affixed. The blade 12 comprises an outer wall 18 (see also FIG. 2) that is affixed at a radially inner end 18A thereof to the platform assembly 16.

Figure 2:
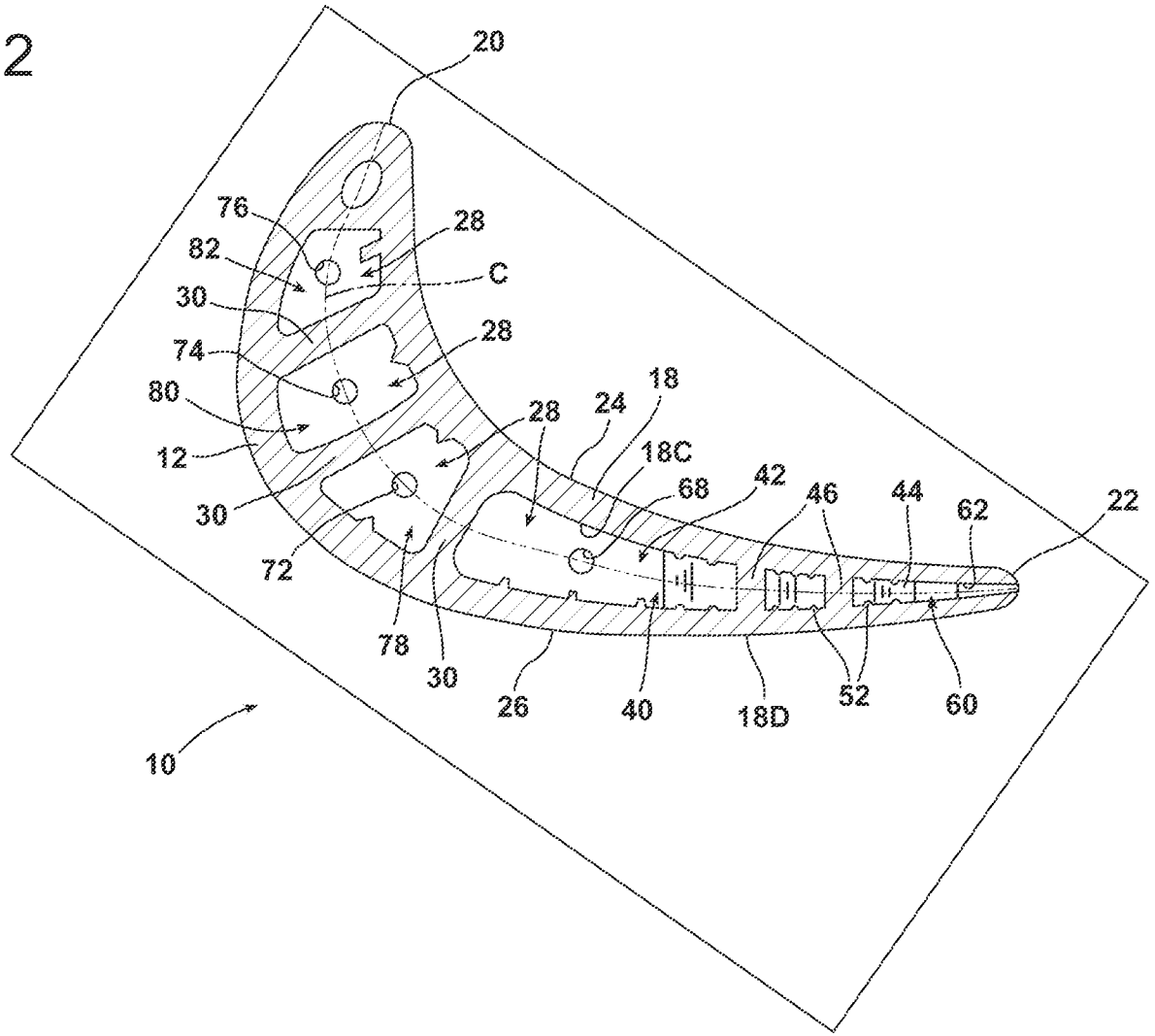
FIG. 2 is cross sectional view of the airfoil assembly of FIG. 1 taken along line 2-2 in FIG. 1.

Referring to FIG. 2, the outer wall 18 includes a leading edge 20, a trailing edge 22 spaced from the leading edge 20 in a chordal direction C, a concave-shaped pressure side 24, a convex-shaped suction side 26, the radially inner end 18A, and a radially outer end 18B (see FIG. 1). It is noted that a portion of the suction side 26 of the blade 12 illustrated in FIG. 1 has been removed to show selected internal structures within the blade 12, as will be described herein.

As shown in FIG. 2, an inner surface 18C of the outer wall 18 defines a hollow interior portion 28 extending between the pressure and suction sides 24, 26 from the leading edge 20 to the trailing edge 22 and from the radially inner end 18A to the radially outer end 18B. A plurality of rigid spanning structures 30 extend within the hollow interior portion 28 from the pressure side 24 to the suction side 26 and from the radially inner end 18A to the radially outer end 18B to provide structural rigidity for the blade 12 and to divide the hollow interior portion 28 into a plurality of sections, which will be described below. The spanning structures 30 may be formed integrally with the outer wall 18. A conventional thermal barrier coating (not shown) may be provided on an outer surface 18D of the outer wall 18 to increase the heat resistance of the blade 12, as will be apparent to those skilled in the art.

In accordance with the present invention, the airfoil assembly 10 is provided with a cooling system 40 for effecting cooling of the blade 12 toward the trailing edge 22 of the outer wall 18. As noted above, while the description of the cooling system 40 pertains to a blade assembly, it is contemplated that the concepts of the cooling system 40 of the present invention could be incorporated into a vane assembly.

As shown in FIGS. 1 and 2, the cooling system 40 is located in the hollow interior portion 28 of the outer wall 18 toward the trailing edge 22. The cooling system 40 comprises a cooling fluid cavity 42 defined in the outer wall 18 between the pressure and suction sides 24, 26 and extending generally radially between the inner and outer ends 18A, 18B of the outer wall 18. The cooling fluid cavity 42 receives cooling fluid from the platform assembly 16 for cooling the outer wall 18 near the trailing edge 22, as will be described below.

Figure 1A:
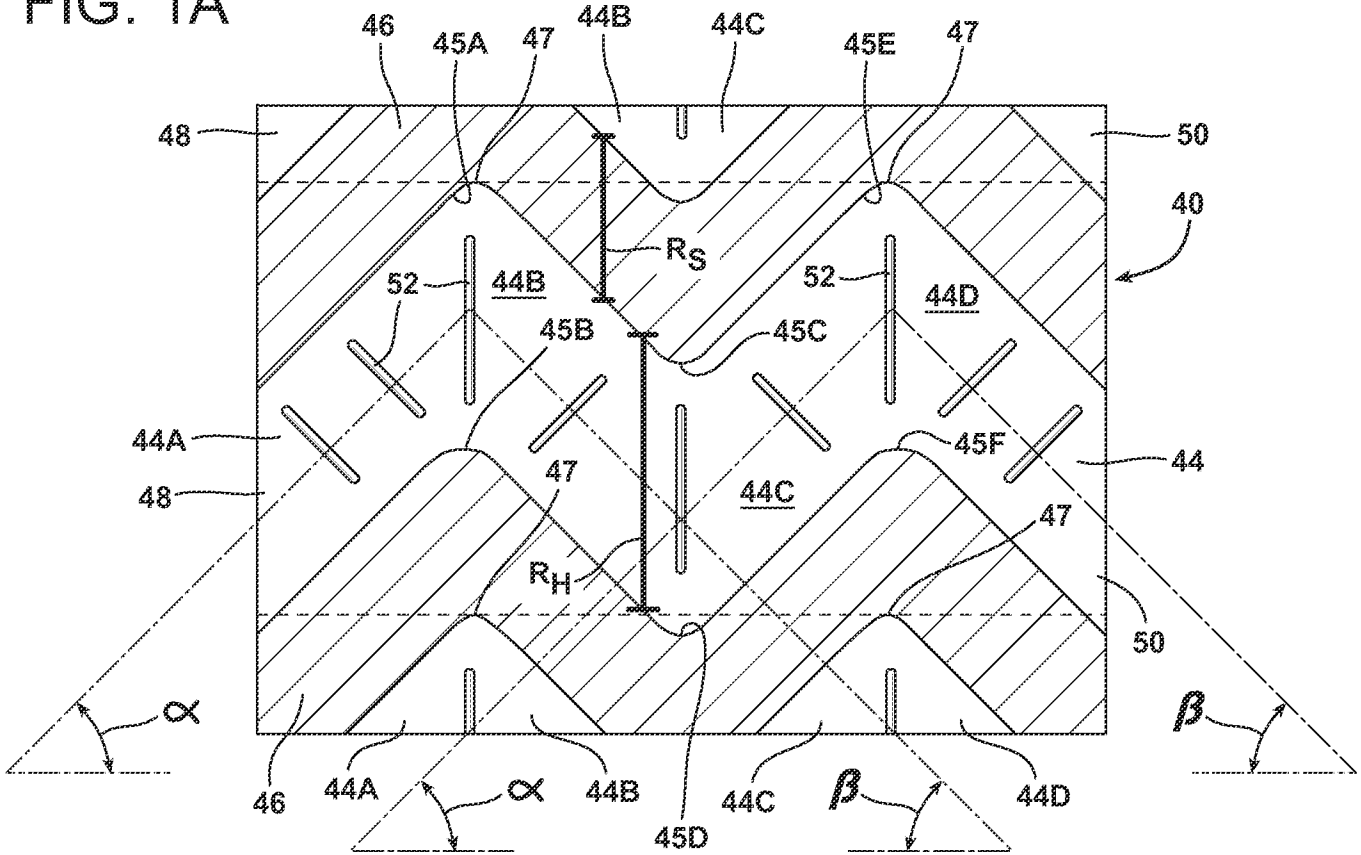
FIG. 1A is an enlarged side cross sectional view of a portion of the airfoil assembly of FIG. 1.

The cooling system 40 further comprises a plurality of cooling fluid passages 44 in fluid communication with the cooling fluid cavity 42, see FIGS. 1, 1A, and 2. The cooling fluid passages 44 extend from the cooling fluid cavity 42 toward the trailing edge 22 and comprise zigzagged passages that include alternating angled sections 44A, 44B, 44C, 44D in the embodiment shown, see FIG. 1A.

As illustrated in FIG. 1A, each section 44A-D includes both a radial component and a chordal component, so as to generally give the cooling fluid passages 44 according to this embodiment an M-shape. That is, the first section 44A is angled radially outwardly and chordally downstream toward the trailing edge 22, the second section 44B is angled radially inwardly and chordally downstream toward the trailing edge 22, the third section 44C is angled radially outwardly and chordally downstream toward the trailing edge 22, and the fourth section 44D is angled radially inwardly and chordally downstream toward the trailing edge 22. While the cooling fluid passages 44 in the embodiment shown comprise four alternating sections 44A-D, the cooling fluid passages 44 could include fewer alternating sections, i.e., as few as two alternating sections, or additional alternating sections, as desired.

In the embodiment shown, the chordal component of each section 44A-D is substantially equal to the radial component for the corresponding section 44A-D, although it is noted that the cooling fluid passages 44 could be configured alternatively, such as wherein the chordal component of each section 44A-D is about 75-125% with respect to the radial component for the corresponding section 44A-D. Further, as shown in FIG. 1A, an angle $\alpha$ of each radially outwardly extending section, i.e., the first and third sections 44A, 44C, is substantially equal and opposite to an angle $\beta$ of each radially inwardly extending section, i.e., the second and fourth sections 44B, 44D, although it is noted that the cooling fluid passages 44 could be configured alternatively, such as wherein angle $\alpha$ of the first and third sections 44A, 44C is about 75-125% with respect to the angle $\beta$ of the second and fourth sections 44B, 44D. In one exemplary embodiment, the angle $\alpha$ of the first and third sections 44A, 44C may be about 25-60° relative to a central axis $C_A$ of the engine (see FIG. 1), and the angle $\beta$ of the second and fourth sections 44B, 44D may be about (−25)-(−60)°. While the first section 44A is illustrated in FIGS. 1, 1A, and 2 as extending radially outwardly and chordally downstream toward the trailing edge 22, it is noted that the first section 44A could extend radially inwardly and chordally downstream toward the trailing edge 22, wherein the subsequent sections 44B, 44C, 44D would also be oppositely angled than as shown in FIG. 1A, see, for example, the embodiment of the invention illustrated in FIG. 3, which will be discussed below.

Additionally, turns 45A, 45B, 45C, 45D, 45E, 45F (see FIG. 1A) between adjacent sections 44A-D of each cooling passage 44 comprise continuously curved walls 46, which walls 46 may be formed as part of the outer wall 18, as shown in FIGS. 1, 1A, and 2. The turns 45A-F provide for flow turning and boundary layer restart in continuously curved cooling fluid passages 44, resulting in more flow turbulence and higher heat transfer through the cooling fluid passages 44.

Further, as shown most clearly in FIG. 1A, respective sections 44A-D of radially adjacent cooling fluid passages 44 are nested together in close proximity to each other to make efficient use of space within the blade 12 and to increase the number of cooling fluid passages 44 formed within the blade 12. The cooling fluid passages 44 according to this embodiment are configured such that radial peaks 47, i.e., radially outermost sections, of the cooling fluid passages 44 are located at substantially the same radial location as radially inner portions of an entrance portion 48 and an exit portion 50 of the radially outwardly adjacent cooling fluid passage 44. It is also contemplated that the radial peaks 47 of the cooling fluid passages 44 could be located radially outwardly from or radially inwardly from the radial location of the inner portion of the entrance portion 48 and/or the radial location of the inner portion of the exit portion 50 of the radially outwardly adjacent cooling fluid passage 44. As shown in FIG. 1A, radial heights $R_H$ of the cooling passages 44 are greater than radial spaces $R_S$ between radially adjacent cooling passages 44.

The cooling fluid passages 44 are tapered in the circumferential direction between the pressure and suction sides 24, 26 of the outer wall 18 as the cooling fluid passages 44 extend from the cooling fluid cavity 42 toward the trailing edge 22 of the outer wall 18, see FIG. 2. The tapering of the cooling fluid passages 44 is effected by the converging of the pressure and suction sides 24, 26 of the outer wall 18 at the trailing edge 22.

In the embodiment, turbulating features comprising turbulator ribs 52 (see FIGS. 1, 1A, and 2) are formed on or are otherwise affixed to the inner surface 18C of the outer wall 18 within the cooling fluid passages 44. The turbulator ribs 52 extend into the cooling fluid passages 44 and effect a turbulation of the cooling fluid flowing therethrough so as to increase cooling provided to the outer wall 18 by cooling fluid passing through the cooling fluid passages 44.

Referring to FIGS. 1 and 2, the cooling system 40 further comprises a cooling fluid channel 60 that extends generally radially between the pressure and suction sides 24, 26 and between the inner and outer ends 18A, 18B of the outer wall 18. The cooling system 40 additionally comprises a plurality of generally chordally extending outlet passages 62 formed in the outer wall 18 at the trailing edge 22. The cooling fluid channel 60 receives cooling fluid from the cooling fluid passages 44 and may be configured as a single channel, as shown in FIG. 1, or as multiple, radially spaced apart channels that collectively define the cooling fluid channel 60. The outlet passages 62 receive the cooling fluid from the cooling fluid channel 60 and discharge the cooling fluid from the cooling system 40, i.e., the cooling fluid exits the blade 12 of the airfoil assembly 10 via the outlet passages 62. The cooling fluid is then mixed with the hot working gas passing through the turbine section 14. The outlet passages 62 may be located along substantially the entire radial length of the outer wall 18, or may be selectively located along the trailing edge 22 to fine tune cooling provided to specific areas.

Referring to FIGS. 1 and 2, the platform assembly 16 includes an opening 68 formed therein in communication with the cooling fluid cavity 42. The opening 68 allows cooling fluid to pass from a cavity 70 (see FIG. 1) formed in the platform assembly 16 into the cooling fluid cavity 42. The cavity 70 formed in the platform assembly 16 may receive cooling fluid, such as compressor discharge air, as is conventionally known in the art.

The platform assembly 16 may be provided with additional openings 72, 74, 76 (see FIG. 1) that supply cooling fluid to additional cavities 78, 80, 82 (see FIG. 2) or sections within the hollow interior portion 28 of the outer wall 18 of the blade 12. Cooling fluid is provided from the cavity 70 in the platform assembly 16 into the cavities 78, 80, 82 to provide additional cooling to the blade 12, as will be apparent to those skilled in the art.

During operation, cooling fluid is provided to the cavity 70 in the platform assembly 16 in any known manner, as will be apparent to those skilled in the art. The cooling fluid passes into the cooling fluid cavity 42 and the additional cavities 78, 80, 82 formed in the blade 12 from the cavity 70 in the platform assembly 16, see FIGS. 1 and 2.

The cooling fluid passing into the cooling fluid cavity 42 flows radially outwardly and flows into the cooling fluid passages 44 via the entrance portions 48 thereof. The cooling fluid provides convective cooling to the outer wall 18 of the blade 12 near the trailing edge 22 as it passes through the cooling fluid passages 44. Due to the configuration of the cooling fluid passages 44, i.e., due to the alternating angled sections 44A-D, the passage length of the cooling fluid passages 44 is increased, as opposed to a straight cooling fluid passage. Hence, the effective surface area of the walls 46 associated with each cooling fluid passage 44 is increased, so as to increase cooling to the outer wall 18 provided by the cooling fluid passing through the cooling fluid passages 44 (as opposed to a straight cooling fluid passage.) Moreover, the turbulator ribs 52 in the cooling fluid passages 44 turbulate the flow of cooling fluid so as to further increase the amount of cooling provided to the outer wall 18 of the blade 12 by the cooling fluid. Once the cooling fluid has traversed the cooling fluid passages 44, the cooling fluid passes into the cooling fluid channel 60 via the exit portions 50 of the cooling fluid passages 44.

The cooling fluid provides convective cooling for the outer wall 18 of the blade 12 near the trailing edge 22 as it flows within the cooling fluid channel 60, and provides additional convective cooling for the outer wall 18 of the blade 12 near the trailing edge 22 as it flows out of the cooling system 40 and the blade 12 through the outlet passages 62. It is noted that the diameters of the outlet passages 62 may be sized so as to meter the cooling fluid passing out of the cooling system 40. Further, it is noted that each outlet passage 62 may have the same diameter size, or outlet passages 62 located at select radial locations may have different diameter sizes so as to fine tune cooling provided to the outer wall 18 at the corresponding radial locations.

It is noted that, in the embodiment shown, the cooling fluid passages 44 are configured such that cooling fluid flowing through each cooling fluid passage 44 does not mix with cooling fluid flowing through the other cooling fluid passages 44 until the cooling fluid exits the cooling fluid passages 44 and enters the cooling fluid channel 60. According to one aspect of the invention, the cooling system 40 may be formed using a sacrificial ceramic insert (not shown). The ceramic insert may include small, radially extending pedestals between adjacent portions of the ceramic insert that form the cooling fluid passages 44 of the cooling system 40, i.e., upon a dissolving/melting of the adjacent portions, the cooling fluid passages 44 are formed. If such a ceramic insert having small pedestals is used, small passageways may be formed between radially adjacent cooling fluid passages 44, such that a small amount of leakage may occur between the adjacent cooling fluid passages 44. Hence, the invention is not intended to be limited to the cooling fluid passages 44 being configured such that cooling fluid flowing through each cooling fluid passage 44 does not mix with cooling fluid flowing through the other cooling fluid passages 44.

Figure 3:
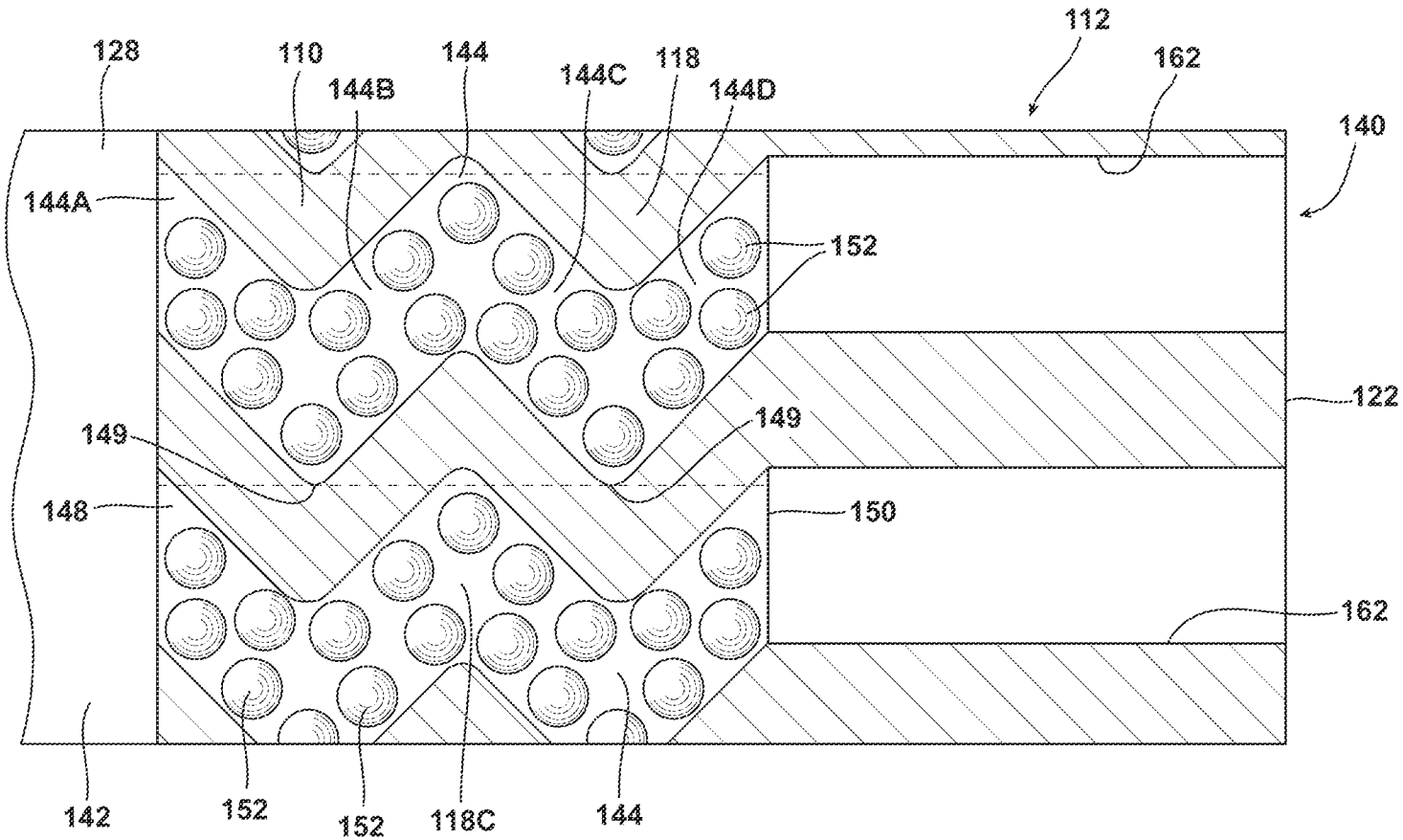
FIG. 3 is an enlarged side cross sectional view of a portion of an airfoil assembly to be cooled in a gas turbine engine according to another embodiment of the invention.

Referring now to FIG. 3, a portion of a cooling system 140 for implementation in an airfoil assembly 110 according to another embodiment is illustrated, where structure similar to that described above with reference to FIGS. 1, 1A, and 2 includes the same reference number increased by 100.

The cooling system 140 is located in a hollow interior portion 128 of an outer wall 118 of a blade 112 of the airfoil assembly 110 toward a trailing edge 122 of the outer wall 118. The cooling system 140 comprises a cooling fluid cavity 142 defined in the outer wall 118 between pressure and suction sides (not shown in this embodiment) and extending generally radially between inner and outer ends (not shown in this embodiment) of the outer wall 118. The cooling fluid cavity 142 receives cooling fluid from a platform assembly (not shown in this embodiment) for cooling the outer wall 118 of the blade 112 near the trailing edge 122.

The cooling system 140 further comprises a plurality of cooling fluid passages 144 in fluid communication with the cooling fluid cavity 142. The cooling fluid passages 144 extend from the cooling fluid cavity 142 toward the trailing edge 122 of the outer wall 118 and comprise zigzagged passages that include alternating angled sections 144A, 144B, 144C, 144D.

Each section 144A-D includes both a radial component and a chordal component, so as to generally give the cooling fluid passages 144 according to this embodiment a W-shape. Further, as shown in FIG. 3, respective sections 144A-D of radially adjacent cooling fluid passages 144 are nested together in close proximity to each other to make efficient use of space within the blade 112 and to increase the number of cooling fluid passages 144 formed within the blade 112. The cooling fluid passages 144 in the embodiment shown are configured such that radial valleys 149 i.e., radially innermost sections, of the cooling fluid passages 144 are located at substantially the same radial location as outer portions of an entrance portion 148 and an exit portion 150 of a radially inwardly adjacent cooling fluid passage 144. It is also contemplated that the radial valleys 149 of the cooling fluid passages 144 could be located radially outwardly or radially inwardly from the radial location of the outer portion of the entrance portion 148 and/or the radial location of the outer portion of the exit portion 150 of the radially inwardly adjacent cooling fluid passage 144.

In this embodiment, turbulating features comprising indentations or dimples 152 are formed in an inner surface 118C of the outer wall 118 within the cooling fluid passages 144. The dimples 152 extend into the inner surface 118C of the outer wall 118 within the cooling fluid passages 144 and effect a turbulation of the cooling fluid flowing through the cooling fluid passages 144 so as to increase cooling provided to the outer wall 118 by the cooling fluid flowing through the cooling fluid passages 144.

In the embodiment shown in FIG. 3, the cooling system 140 does not include a cooling fluid chamber as described above with reference to FIGS. 1 and 2. Rather, the cooling fluid passages 144 according to this embodiment are in direct fluid communication with outlet passages 162, which outlet passages 162 discharge cooling fluid from the cooling system 140, as described above.

Figure 4:
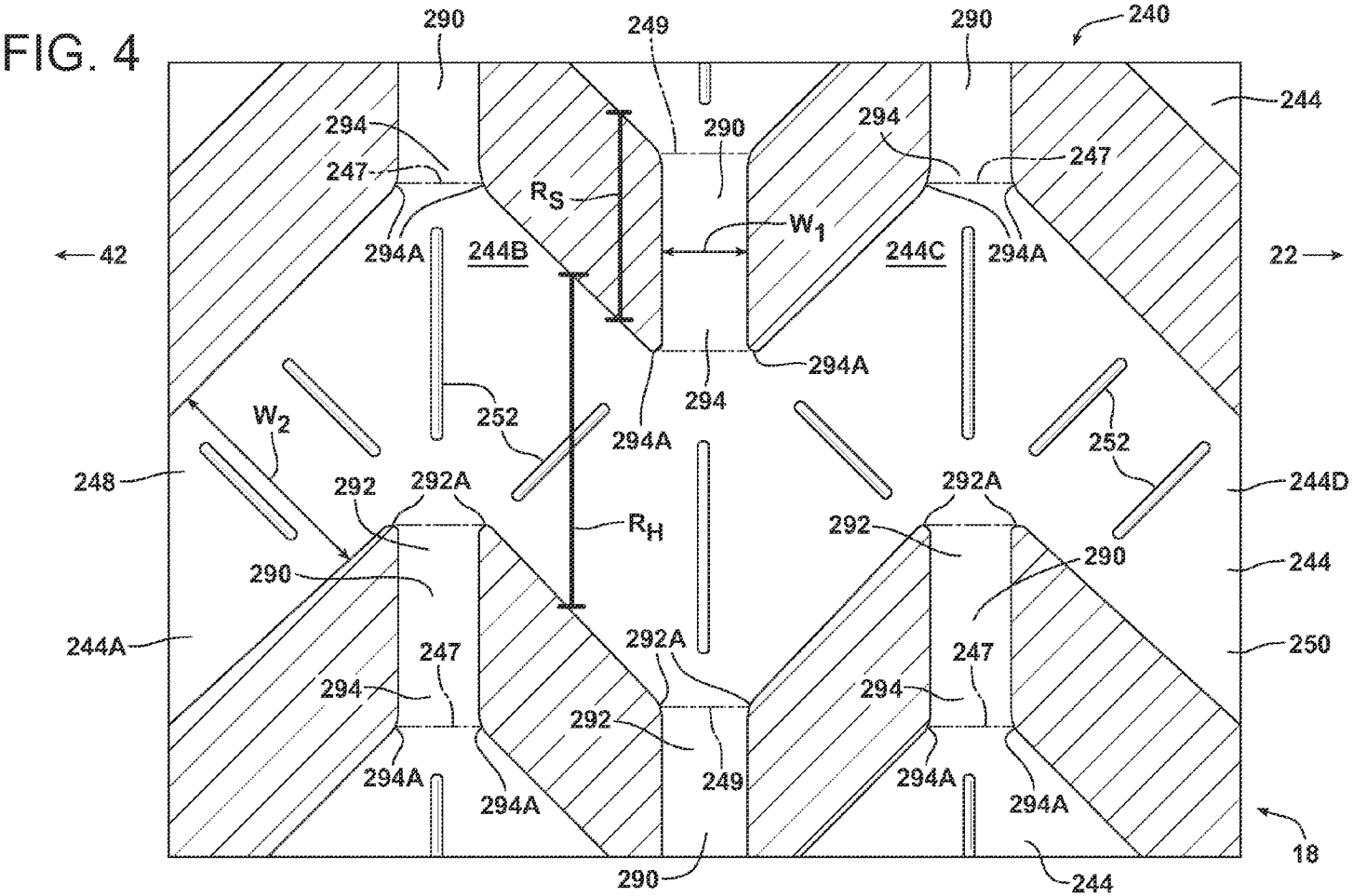
FIG. 4 is an enlarged side cross sectional view of a portion of an airfoil assembly to be cooled in a gas turbine engine according to another embodiment of the invention.

Referring now to FIG. 4, a portion of a cooling system 240 for implementation in an airfoil assembly, such as the airfoil assembly 10 described above with reference to FIGS. 1, 1A, and 2, according to another embodiment of the invention is illustrated. The cooling system 240 according to this embodiment may be used in place of the cooling system 40 described above for FIGS. 1, 1A, and 2. Hence, the structure of the airfoil assembly 10 described above, including the blade 12 and platform assembly 16 pertains to the cooling system 240 of FIG. 4 and thus will not be described in detail with reference to the cooling system 240 of FIG. 4.

Similar to the cooling system 40 of FIGS. 1, 1A, and 2, the cooling system 240 according to this embodiment may be located in the hollow interior portion 28 of the blade outer wall 18 toward the trailing edge 22, see FIGS. 1 and 2. The cooling system 240 comprises a cooling fluid cavity (see the cooling fluid cavity 42 of FIGS. 1 and 2) defined in the outer wall 18 between pressure and suction sides 24, 26 of the blade 12 and extending generally radially between inner and outer ends 18A, 18B of the outer wall 18, see FIGS. 1 and 2. As described above, the cooling fluid cavity 42 receives cooling fluid from the platform assembly 16 for cooling the outer wall 18 of the blade 12 near the trailing edge 22.

The cooling system 240 further comprises a plurality of cooling fluid passages 244 in fluid communication with the cooling fluid cavity 42. The cooling fluid passages 244 extend from the cooling fluid cavity 42 toward the trailing edge 22 of the blade outer wall 18 and comprise zigzagged passages that include alternating angled sections 244A, 244B, 244C, 244D.

Each section 244A-D includes both a radial component and a chordal component, so as to generally give the cooling fluid passages 244 according to this embodiment a zigzag or serpentine shape. Further, as shown in FIG. 4, respective sections 244A-D of radially adjacent cooling fluid passages 244 are nested together in close proximity to each other to make efficient use of space within the blade 12 and to increase the number of cooling fluid passages 244 formed within the blade 12 as described above with reference to FIGS. 1, 1A, and 2.

In this embodiment, the cooling system 240 further comprises a plurality of radial passageways 290 interconnecting radially adjacent ones of the cooling fluid passages 244. As shown in FIG. 4, the radial passageways 290 are formed between radial peaks 247 and radial valleys 249 of the respective radially adjacent cooling fluid passages 244. The radial passageways 290 may have the same configuration in each cooling fluid passage 244 as shown in FIG. 4, i.e., wherein the radial passageways 290 in each cooling passage 244 are all aligned with one another, or they may be formed in other patterns, such as a staggered pattern wherein radially adjacent radial passageways 290 are not aligned with one another, or a random pattern. Moreover, it is noted that while the radial passageways 290 shown in FIG. 4 are formed between respective radial peaks and valleys 247, 249 of radially adjacent cooling fluid passages 244, the radial passageways 290 may be formed at other suitable locations in addition to or lieu of being formed between respective radial peaks and valleys 247, 249 of radially adjacent cooling fluid passages 244.

While the radial passageways 290 may have any suitable dimensions, they preferably have widths $W_1$ that are of a substantial size to provide sufficient strength for a ceramic core (not shown) that is used during a casting process to form the cooling system 240 in the blade 12. For example, the width $W_1$ of the radial passageways 290 may be at least about half of a width $W_2$ of the cooling fluid passages 244 as shown in FIG. 4. Such a width $W_1$ of the radial passageways 290 is believed to provide sufficient strength for the ceramic core.

Further, while first and second opposed end portions 292, 294 of the radial passageways 290 in the embodiment shown have rounded corners 292A, 294A, which rounded corners 292A, 294A are believed to promote a smooth flow of cooling fluid through the cooling system 240, the first and second end portions 292, 294 of the radial passageways 290 could have sharp or less rounded corners 292A, 294A.

Since the radial passageways 290 interconnect each of the radially adjacent cooling fluid passages 244, cooling fluid passing through the cooling system 240 during operation is able to flow between the adjacent cooling fluid passages 244 through the radial passageways 290, thus increasing the surface area through which the cooling fluid flows, thereby increasing heat transfer and improving engine efficiency. Further, the radial passageways 290 of FIG. 4 are preferably formed by structural pedestals of the ceramic core that is used during the casting process to form the cooling system 240. Hence, the structural rigidity of the ceramic core is increased over ceramic cores used to produce cooling system configurations that do not include such radial passageways formed by structural pedestals of the ceramic core.

Remaining structure of the cooling system 240 illustrated in FIG. 4 is substantially as described above with reference to the cooling system 40 of FIGS. 1, 1A, and 2.

It is noted that, while entrance and exit portions 48, 148, 248, 50, 150, 250 of the cooling fluid passages 44, 144, 244 illustrated herein lead directly to/from the respective angled first and fourth passage sections 44A-D, 144A-D, 244A-D, the entrance and exit portions 48, 148, 248, 50, 150, 250 could include generally chordally extending portions that lead into/from the respective angled first and fourth passage sections 44A-D, 144A-D, 244A-D.

Further, while the cooling fluid passages 44, 244 according to the embodiment of FIGS. 1, 1A, 2, and 4 are configured such that the radial peaks 47, 247 are located at substantially the same radial location as the radially inner portions of the entrance and exit portions 48, 248, 50, 250 of the radially outwardly adjacent cooling fluid passage 44, 244, and the cooling fluid passages 144 according to the embodiment of FIG. 3 are configured such that the radial valleys 149 are located at substantially the same radial location as the radially outer portions of the entrance and exit portions 148, 150 of the radially inwardly adjacent cooling fluid passage 144, a combination of these two embodiments is also contemplated. That is, a cooling fluid passage may be configured such that a peak thereof is located at substantially the same radial location as (or radially outwardly from) entrance and exit portions of a radially outwardly adjacent cooling fluid passage, and such that a valley thereof is located at substantially the same radial location as (or radially inwardly from) entrance and exit portions of a radially inwardly adjacent cooling fluid passage.

Finally, it is noted that the radial passageways 290 of FIG. 4, which include turbulating features in the form of turbulator ribs 252 as shown in FIG. 4, could be implemented in the cooling system 140 of FIG. 3, which includes turbulating features in the form of dimples 152, to effect an increase in the structural rigidity of a ceramic core used to produce the cooling system 140 of FIG. 3. The radial passageways 290 from the embodiment of FIG. 4 in the cooling system 140 of FIG. 3 would also increase the surface area of the cooling system 140 of FIG. 3, thus further increasing heat transfer and improving engine efficiency.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil in a gas turbine engine comprising:

an outer wall including a leading edge, a trailing edge, a pressure side, a suction side, a radially inner end, and a radially outer end, wherein a chordal direction is defined between the leading edge and the trailing edge;

a cooling fluid cavity defined in the outer wall and extending generally radially between the inner end and the outer end of the outer wall, the cooling fluid cavity receiving cooling fluid for cooling the outer wall;

a plurality of cooling fluid passages in fluid communication with the cooling fluid cavity, the cooling fluid passages comprising alternating angled sections, each section having both a radial component and a chordal component, the cooling fluid passages extending from the cooling fluid cavity toward the trailing edge of the outer wall and receiving cooling fluid from the cooling fluid cavity for cooling the outer wall near the trailing edge; and a plurality of radial passageways interconnecting radially adjacent cooling fluid passages, wherein the radial passageways are formed between radial peaks and radial valleys of respective radially adjacent cooling fluid passages.

2. The airfoil according to claim 1, wherein the radial passageways between radially adjacent cooling fluid passages have the same configuration in each cooling fluid passage such that corresponding radial passageways in each cooling passage are aligned with one another.

3. The airfoil according to claim 1, wherein widths of the radial passageways are about half of widths of the cooling fluid passages.

4. The airfoil according to claim 1, wherein the respective sections of radially adjacent cooling fluid passages are nested together in close proximity to each other.

5. The airfoil according to claim 4, wherein the cooling fluid passages are configured such that at least one of:

the radial peaks of at least some of the cooling fluid passages are located at a radial location at or radially outwardly from a radial location of at least one of an entrance portion and an exit portion of a radially outwardly adjacent cooling fluid passage; and the radial valleys of at least some of the cooling fluid passages are located at a radial location at or radially inwardly from a radial location of at least one of an entrance portion and an exit portion of a radially inwardly adjacent cooling fluid passage.

6. The airfoil according to claim 1, wherein first and second end portions of the radial passageways have rounded corners.

7. The airfoil according to claim 1, further comprising a plurality of outlet passages located in the outer wall at the trailing edge, the outlet passages receiving cooling fluid from the cooling fluid passages and discharging the cooling fluid from the airfoil.

8. The airfoil according to claim 7, further comprising a cooling fluid channel located between the cooling fluid passages and the outlet passages and extending generally radially between the inner end and the outer end of the outer wall, the cooling fluid channel receiving cooling fluid from the cooling fluid passages and delivering the cooling fluid to the cooling fluid outlets.

9. The airfoil according to claim 1, wherein the chordal component is substantially equal to the radial component for each section.

10. The airfoil according to claim 1, wherein the alternating angled sections of each cooling fluid passage comprise at least a first section angled radially outwardly in a downstream direction and at least a second section extending from the first section and angled radially inwardly in the downstream direction such that the cooling fluid passages comprise zigzagged passages.

11. The airfoil according to claim 10, wherein the angle of the second section is substantially equal and opposite to the angle of the first section.

12. The airfoil according to claim 1, wherein the cooling fluid passages are tapered in the circumferential direction defined between the pressure side and the suction side of the outer wall as the cooling fluid passages extend from the cooling fluid cavity toward the trailing edge of the outer wall.

13. The airfoil according to claim 1, wherein the outer wall is coupled to a platform assembly associated with the airfoil and the cooling fluid is provided to the cooling fluid cavity through the platform assembly.

14. The airfoil according to claim 1, wherein the cooling fluid passages are cast integrally with the outer wall using a sacrificial ceramic core.

15. An airfoil in a gas turbine engine comprising:

an outer wall including a leading edge, a trailing edge, a pressure side, a suction side, a radially inner end, and a radially outer end, wherein a chordal direction is defined between the leading edge and the trailing edge;

a cooling fluid cavity defined in the outer wall, the cooling fluid cavity receiving cooling fluid for cooling the outer wall;

a plurality of cooling fluid passages including alternating angled sections that provide each cooling fluid passage with a zigzag or serpentine shape, each section extending radially and chordally toward the trailing edge of the outer wall, the cooling fluid passages receiving cooling fluid from the cooling fluid cavity for cooling the outer wall near the trailing edge; and a plurality of radial passageways interconnecting radially adjacent cooling fluid passages formed between radial peaks and radial valleys of respective radially adjacent cooling fluid passages.

16. The airfoil according to claim 15, further comprising:

a cooling fluid channel located downstream from the cooling fluid passages, the cooling fluid channel receiving cooling fluid from the cooling fluid passages; and a plurality of outlet passages located in the outer wall at the trailing edge, the outlet passages receiving cooling fluid from the cooling fluid channel and discharging the cooling fluid from the airfoil.

17. The airfoil according to claim 15, wherein the respective sections of radially adjacent cooling fluid passages are nested together in close proximity to each other.

18. The airfoil according to claim 17, wherein the cooling fluid passages are configured such that at least one of:

the radial peaks of at least some of the cooling fluid passages are located at a radial location at or radially outwardly from a radial location of at least one of an entrance portion and an exit portion of a radially outwardly adjacent cooling fluid passage; and the radial valleys of at least some of the cooling fluid passages are located at a radial location at or radially inwardly from a radial location of at least one of an entrance portion and an exit portion of a radially inwardly adjacent cooling fluid passage.

19. An airfoil in a gas turbine engine comprising:

an outer wall including a leading edge, a trailing edge, a pressure side, a suction side, a radially inner end, and a radially outer end, wherein a chordal direction is defined between the leading edge and the trailing edge;

a cooling fluid cavity defined in the outer wall and extending generally radially between the inner end and the outer end of the outer wall, the cooling fluid cavity receiving cooling fluid for cooling the outer wall;

a plurality of cooling fluid passages in fluid communication with the cooling fluid cavity, the cooling fluid passages comprising alternating angled sections, each section having both a radial component and a chordal component, the cooling fluid passages extending from the cooling fluid cavity toward the trailing edge of the outer wall and receiving cooling fluid from the cooling fluid cavity for cooling the outer wall near the trailing edge, wherein radial heights of the cooling passages are greater than radial spaces between radially adjacent cooling passages, and wherein the cooling fluid passages are tapered in the circumferential direction defined between the pressure side and the suction side of the outer wall as the cooling fluid passages extend from the cooling fluid cavity toward the trailing edge of the outer wall; and a plurality of radial passageways interconnecting radially adjacent cooling fluid passages.

20. The airfoil according to claim 19, wherein the radial passageways are formed between radial peaks and radial valleys of respective radially adjacent cooling fluid passages.

* * * * *